US012747916B2

(12) United States Patent
Lojek, III et al.

(10) Patent No.: US 12,747,916 B2
(45) Date of Patent: Sep. 29, 2026

(54) HEAT PIPE THERMAL EXPANSION MODIFICATION

(71) Applicant: Westinghouse Electric Company LLC, Cranberry Township, PA (US)

(72) Inventors: John Lojek, III, Latrobe, PA (US); Tyler Imprescia, Cranberry Township, PA (US); Rory A.F. Blunt, Pittsburgh, PA (US); Christopher M. Nestor, Murrysville, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 10 days.

(21) Appl. No.: 18/827,710

(22) Filed: Sep. 7, 2024

(65) Prior Publication Data

US 2026/0071824 A1 Mar. 12, 2026

(51) Int. Cl.
*F28D 15/04* (2006.01)

(52) U.S. Cl.
CPC ..... *F28D 15/04* (2013.01)

(58) Field of Classification Search
CPC .... F28D 15/04; F28D 15/046; F28D 15/0208; F28D 15/0275; F28F 9/26; F28F 2265/26
See application file for complete search history.

(56) References Cited

U.S. PATENT DOCUMENTS 3,517,730 A * 6/1970 Wyatt ..... G21H 1/103 136/202
3,605,878 A * 9/1971 Coleman ..... F28D 15/06 165/274
3,712,053 A * 1/1973 Kofink ..... F28D 15/04 337/2
4,091,264 A 5/1978 Sarcia
5,771,967 A * 6/1998 Hyman ..... B64G 1/50 126/45

(Continued)

FOREIGN PATENT DOCUMENTS

CN 116379821 A 7/2023
CN 220818680 U 4/2024

(Continued)

OTHER PUBLICATIONS

International Search Report and Written Opinion in corresponding International Application No. PCT/US2025/036611, mailed Oct. 8, 2025.

(Continued)

*Primary Examiner* — Tho V Duong
(74) *Attorney, Agent, or Firm* — K&L Gates LLP

(57) ABSTRACT

A heat pipe includes: an elongate tube defining a longitudinal axis; an annular wick positioned in the elongate tube; a wick plug positioned in the elongate tube and attached to an end of the annular wick, where the wick plug includes an annular body defining an opening; a thermal expansion modification device including: an annular plug attached to an end of the elongate tube; and an elongate stem extending from the annular plug and through the opening in the wick plug, where the elongate stem defines a protrusion extending radially relative to the longitudinal axis toward the elongate tube, and where the wick plug is positioned intermediate the protrusion and the annular plug; and an end cap attached to the annular plug.

20 Claims, 8 Drawing Sheets

(56) References Cited

U.S. PATENT DOCUMENTS

| | | | | |
|---|---|---|---|---|
| 12,611,740 | B2 * | 4/2026 | Nestor, III | B23P 15/26 |
| 2004/0112583 | A1 | 6/2004 | Garner et al. | |
| 2014/0090239 | A1 | 4/2014 | Chou | |
| 2021/0325122 | A1 * | 10/2021 | Swartz | F28D 15/04 |
| 2023/0070156 | A1 | 3/2023 | Gross | |

FOREIGN PATENT DOCUMENTS

| | | | | |
|---|---|---|---|---|
| FR | 3003636 | A1 * | 9/2014 | F28D 15/04 |
| TW | I292470 | B | 1/2008 | |
| WO | 2007070243 | A1 | 6/2007 | |

OTHER PUBLICATIONS

Taiwanese Office Action and Search Report for corresponding Taiwanese Application No. 114125487, mailed Jun. 12, 2026.

* cited by examiner

HEAT PIPE THERMAL EXPANSION MODIFICATION

GOVERNMENT CONTRACT

This invention was made with government support under Contract DE-FOA-00001798, Advanced Research Projects Agency-Energy (ARPA-E) Modeling-Enhanced Innovations Trailblazing Nuclear Energy Reinvigoration (MEITNER) award number DE-AR-0000979. The government has certain rights in the invention.

FIELD

The present disclosure is generally related heat pipes to facilitate heat removal and, more particularly, is directed toward heat pipes for use in nuclear reactors.

BACKGROUND

This invention relates generally to heat pipes used in heat transfer systems, and more particularly, to wicks within the heat pipes that are configured to transfer the working fluid of the heat pipe from a condenser region of the heat pipe to an evaporator region.

A heat pipe is a hermetically sealed, two-phase heat transfer component used to transfer heat from a primary side (e.g., an evaporator section) to a secondary side (e.g., a condenser section). FIG. 1, as an example, illustrates a heat pipe 100 comprising the aforementioned evaporator section 102 and condenser section 106, along with an adiabatic section 104 extending therebetween. The heat pipe 100 further includes an elongate tube, a working fluid (such as water, liquid potassium, sodium, or other alkali metal) and a wick 108. In operation, the working fluid is configured to absorb heat in the evaporator section 102 and vaporize. The saturated vapor, carrying latent heat of vaporization, flows towards the condenser section 106 through the adiabatic section 104. In the condenser section 106, the vapor condenses into a liquid 110 and gives off its latent heat. The condensed liquid is then returned to the evaporator section 102 through the wick 108 by capillary action. The aforementioned flow path of the working fluid is illustrated by segmented arrows in FIG. 1. The phase change processes, and two-phase flow circulation continues as long as the temperature gradient between the evaporator and condenser sections is maintained. Due to the very high heat transfer coefficients for boiling and condensation, heat pipes are highly effective thermal conductors.

Generally during assembly of the heat pipe 100, a container lid 114 (e.g., an end cap) is utilized to seal the wick 108 and working fluid within a container 112 (e.g., an elongate tube) of the heat pipe 100. The container lid 114 includes an end plug 116 extending therefrom that is configured to couple to the wick 108 at an interface 118. It is necessary to maintain a seal at the interface 118 between the end plug 116 of the heat pipe 100 and the evaporator section 102 of the wick 108.

In nuclear systems, heat pipes are utilized by placing the evaporator section of the heat pipe within a reactor core containing nuclear fuel and the condenser section is placed near heat exchangers. The nuclear fuel heats up and vaporizes the working fluid within the heat pipe at the evaporator section and heat exchangers absorb the latent heat coming from the condenser section. Example heat pipes in nuclear applications are described in U.S. patent Ser. No. 11/650,016, U.S. Pat. Nos. 5,684,848, 6,768,781, and U.S. patent Ser. No. 10/643,756, all of which are incorporated by reference herein in their entirety.

Further to the above, a design for a floating annular wick heat pipes has previously been disclosed in U.S. patent Ser. No. 10/643,756. The floating annular wick design allows for the use of different materials in the annular wick and the heat pipe wall/tube by separating the heat pipe tube from the wick, and providing space between the two to allow for radial and marginal axial differential thermal expansion. This design however does not contain a locating feature for the wick to prevent the potential for damage to the wick during operation caused by the differential expansion of the different materials used.

Floating wicks allow for heat pipe designs where the wick and heat pipe wall (e.g., elongate tube) are made from different materials with different rates of thermal expansion. During operation, the wick and heat pipe wall may expand/contract or shift relative to one another as they are not coupled. Assuming the heat pipe is heated up uniformly, allowing the alkali metal to uniformly melt into liquid form, this design feature works well to allow differential thermal expansion to occur without damage to the wick. The exception to this ability to shift relative to one another occurs during startup of the heat pipe where non-uniform axial heating may be applied.

In one aspect, an alkali metal such as sodium is used as the working fluid in the heat pipe 100 which is a solid at room temperature. While solid, the alkali metal fixes the wick 108 and elongate tube 112 together preventing the relative motion between the wick 108 and the elongate tube 112. As heat is applied only to the evaporator section 102 in a typical laboratory application and/or in anticipated reactor startup conditions, the alkali metal begins to melt and the local temperature rises. As the heat pipe 100 starts up, a melt front MF progresses along the heat pipe 100 toward the condenser section 106, see FIG. 2. Thus, the heat pipe 100 may not be fully melted until it is operating over a temperature which enables efficient axial heat transfer, depending on the alkali metal used, length of the heat pipe, external conditions and other operating factors. In general, the forced direction of thermal expansion is in direction FD shown in FIG. 2, assuming evaporator end heating. In some instances, if the wick 108 is located near or pressed against the evaporator section 102 of the heat pipe 100 during startup, the differential axial expansion between the wick 108 and tube 112 while the wick 108 is constrained at both ends can result in large compressive forces on the wick 108. This may lead to the mechanical deformation of the wick which can significantly degrade or wholly compromise its capillary capability. Specifically, the annular gap spacing and the capillary pressure rise in the wick 108 are vital to high performance of the heat pipe 100. A wick designed in this manner may lead to the failure of the heat pipe to transfer heat in an axial direction. Therefore, it needs to be ensured that when the wick 108 is in a frozen state, there is space between the wick 108 and the end cap 114 to allow for thermal expansion of the wick 108 (e.g., assuming evaporator end heating is applied).

In some instances, it may be desirable to provide a thermal expansion modification device, or locating feature, for the wick to position the wick relative to the elongate tube of the heat pipe to prevent deformation of the wick in operation.

SUMMARY

The following summary is provided to facilitate an understanding of some of the innovative features unique to the aspects disclosed herein, and is not intended to be a full description. A full appreciation of the various aspects can be gained by taking the entire specification, claims, and abstract as a whole.

In various aspects, a heat pipe is disclosed. The heat pipe includes: an elongate tube defining a longitudinal axis; an annular wick positioned in the elongate tube; a wick plug positioned in the elongate tube and attached to an end of the annular wick, where the wick plug includes an annular body defining an opening; a thermal expansion modification device, including: an annular plug attached to an end of the elongate tube; and an elongate stem extending from the annular plug and through the opening in the wick plug, wherein the elongate stem defines a protrusion extending radially relative to the longitudinal axis toward the elongate tube, and wherein the wick plug is positioned intermediate the protrusion and the annular plug; and an end cap attached to the annular plug.

In various aspects, a heat pipe is disclosed. The heat pipe includes: an elongate tube defining a longitudinal axis; an annular wick positioned in the elongate tube; a wick plug positioned in the elongate tube and attached to an end of the annular wick, where the wick plug comprises an annular body defining an opening; and a tube plug, including: an annular plug attached to an end of the elongate tube; and a shaft extending from the annular plug and through the opening in the annular wick, where the shaft defines a protrusion extending radially toward the elongate tube, and where the wick plug is positioned intermediate the protrusion and the annular plug.

In various aspects, a thermal expansion modification device is disclosed. The thermal expansion modification device includes: an annular plug attached to an end of an elongate tube; an elongate stem extending from the annular plug, the elongate stem defining a longitudinal axis, an exterior surface, and a protrusion extending radially outward from the exterior surface; and an internal passage extending through the annular plug and the elongate stem.

BRIEF DESCRIPTION OF THE DRAWINGS

Various features of the aspects described herein are set forth with particularity in the appended claims. The various aspects, however, both as to organization and methods of operation, together with advantages thereof, may be understood in accordance with the following description taken in conjunction with the accompanying drawings as follows:

Corresponding reference characters indicate corresponding parts throughout the several views. The exemplifications set out herein illustrate various aspects of the disclosure, in one form, and such exemplifications are not to be construed as limiting the scope of the disclosure in any manner.

DETAILED DESCRIPTION

Figure 1:
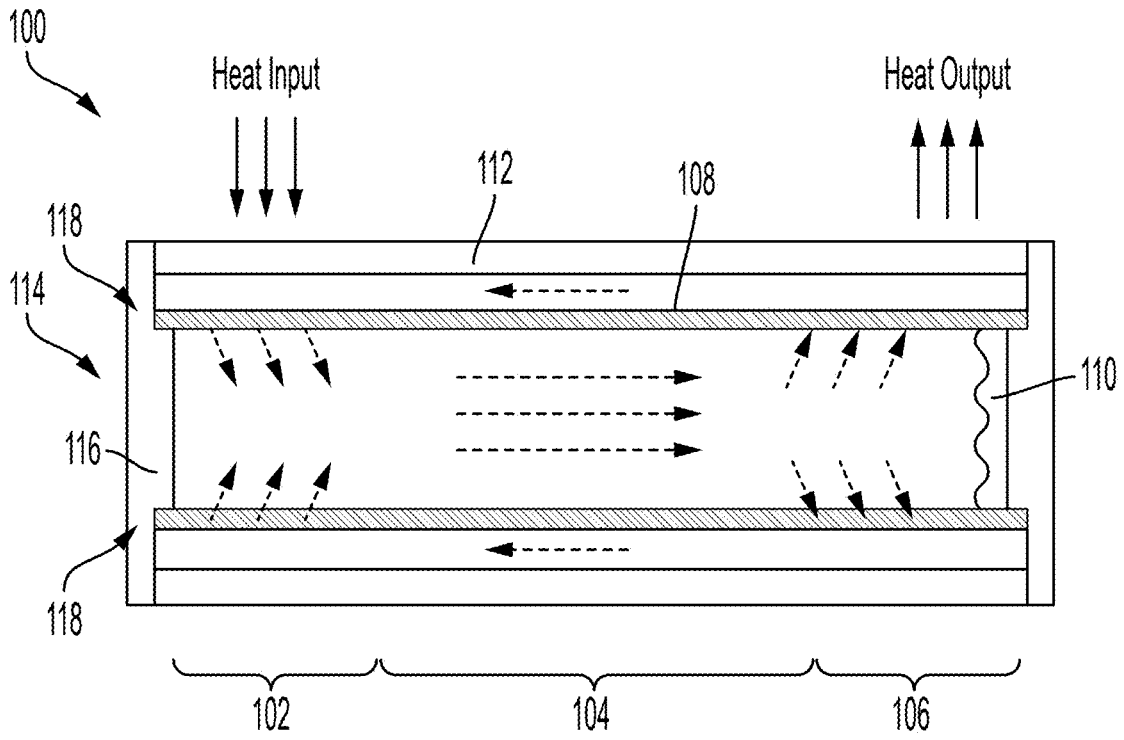
FIG. 1 is a cross-section view of a heat pipe including an annular wick, illustrating a condenser end, an evaporator end, and an adiabatic section of the heat pipe, in accordance with at least one aspect of the present disclosure.
Figure 2:
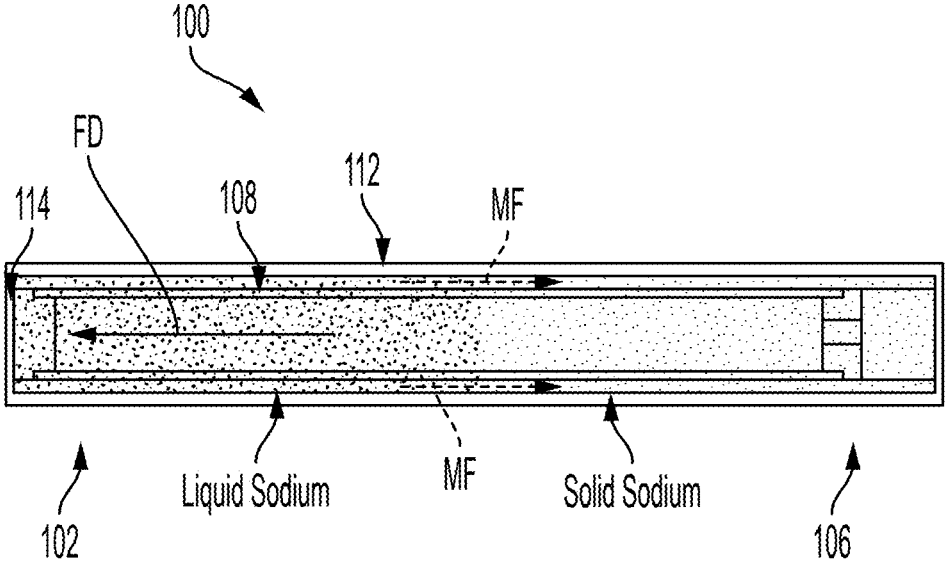
FIG. 2 is a cross-section view of the heat pipe of FIG. 1, illustrating the forced direction of thermal expansion during heat up of the heat pipe, in accordance with at least one aspect of the present disclosure.

Numerous specific details are set forth to provide a thorough understanding of the overall structure, function, manufacture, and use of the aspects as described in the disclosure and illustrated in the accompanying drawings. Well-known operations, components, and elements have not been described in detail so as not to obscure the aspects described in the specification. The reader will understand that the aspects described and illustrated herein are non-limiting examples, and thus it can be appreciated that the specific structural and functional details disclosed herein may be representative and illustrative. Variations and changes thereto may be made without departing from the scope of the claims. Furthermore, it is to be understood that such terms as "forward", "rearward", "left", "right", "upwardly", "downwardly", and the like are words of convenience and are not to be construed as limiting terms.

In the following description, reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Before explaining various aspects of the heat pipe thermal expansion modification device in detail, it should be noted that the illustrative examples are not limited in application or use to the details of construction and arrangement of parts illustrated in the accompanying drawings and description. The illustrative examples may be implemented or incorporated in other aspects, variations, and modifications, and may be practiced or carried out in various ways. Further, unless otherwise indicated, the terms and expressions employed herein have been chosen for the purpose of describing the illustrative examples for the convenience of the reader and are not for the purpose of limitation thereof. Also, it will be appreciated that one or more of the following-described aspects, expressions of aspects, and/or examples, can be combined with any one or more of the other following-described aspects, expressions of aspects, and/or examples.

One solution to the above mentioned issues is a heat pipe that includes a locating feature, or thermal expansion modification device, that positions the wick relative to the heat pipe. More specifically, in at least one aspect, a wick plug attached to the wick and a tube plug attached to the elongate tube of the heat pipe are coupled together to prevent excessive axial movement of the wick. This can ensure sufficient space between the elongate tube plug and the wick plug exists to allow for thermal expansion throughout all operating conditions.

Figure 3:
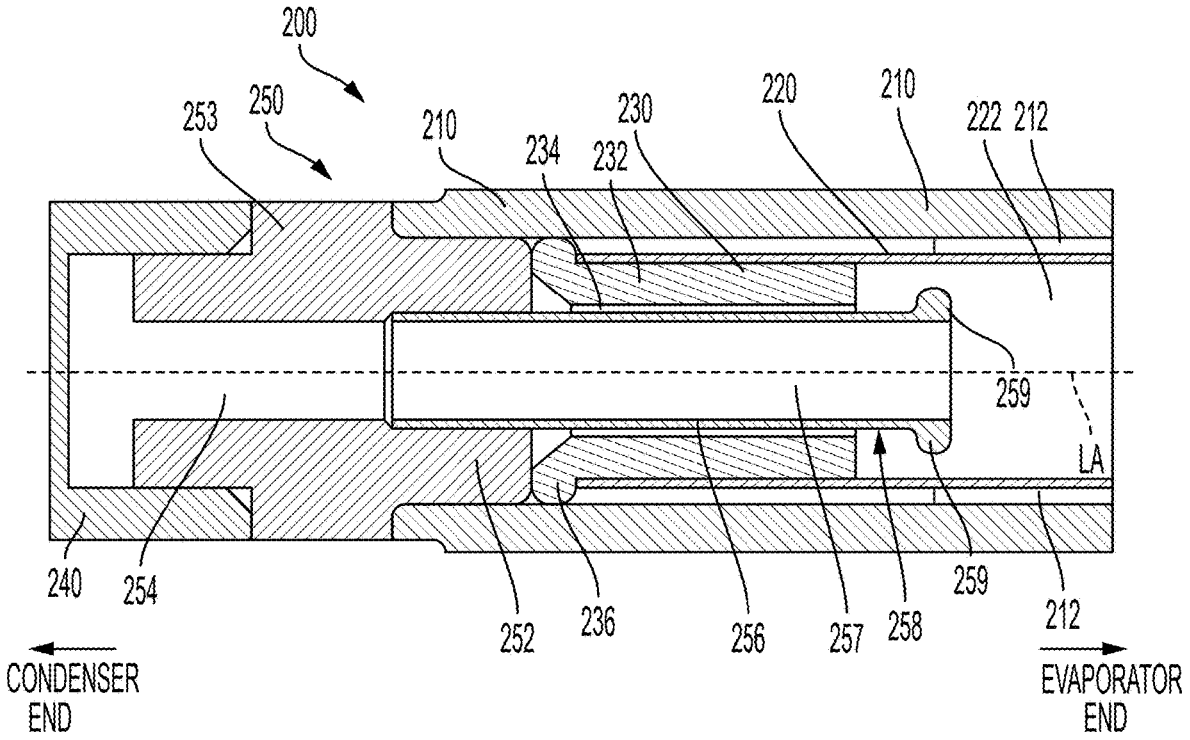
FIG. 3 is a cross-section view of a condenser end of a heat pipe including a thermal expansion modification device, in accordance with at least one aspect of the present disclosure.

FIG. 3 illustrates a heat pipe 200 including an elongate tube 210, an annular wick 220 positioned in an opening 212 defined by the elongate tube 210, and a wick plug 230 positioned in the elongate tube 210 and attached to the condenser end of the annular wick 220. The elongate tube 210 defines a longitudinal axis LA, and the wick plug 230 and the annular wick 220 can float axially within the elongate tube 210 along the longitudinal axis LA. In at least one aspect, the longitudinal axis LA is the centerline of the elongate tube 210. Further, the annular wick 220 defines an inner opening 222 which receives at least a portion of the wick plug 230 therein. The wick plug 230 comprises an annular body 232 defining an opening 234 and an annular protrusion 236 at the condenser end of the annular body 232. In at least one aspect, the wick plug 230 is press fit into the inner opening 222 of the annular wick 220. In at least one aspect, the wick plug 230 is attached to the annular wick 220 by welding, soldering, and/or any other suitable mechanical attachment method. In at least one aspect, the wick plug 230 and the annular wick 220 include interlocking features to couple the wick plug 230 to the annular wick 220. In at least one aspect, the elongate tube 210, the annular wick 220, and the wick plug 230 are concentric about the longitudinal axis LA of the elongate tube 210.

Further to the above, the heat pipe 200 further comprises a condenser end cap 240 and a thermal expansion modification device 250 (e.g., a tube plug). The thermal expansion modification device 250 comprises an annular plug 252 and an elongate stem 256 (e.g., a shaft) extending from the annular plug 252. The annular plug 252 defines a flange portion 253 intermediate the elongate tube 210 and the condenser end cap 240. At least a portion of the annular plug 252 is received within the opening 212 of the elongate tube 210 at the condenser end of the elongate tube 210. In at least one aspect, the annular plug 252 is press fit into the opening 212 of the elongate tube 210 and then welded to the elongate tube 210 to secure the annular plug 252 to the elongate tube 210. In at least one aspect, the elongate stem 256 is press fit into an inner passageway 254 defined in the annular plug 252 to secure the elongate stem 256 to the annular plug 252. In at least one aspect, the elongate stem 256 is press fit into the inner passageway 254 defined in the annular plug 252 and then welded to the annular plug 252 to secure the elongate stem 256 to the annular plug 252. Further, in at least one aspect, the condenser end cap 240 is welded to the annular plug 252 to secure the condenser end cap 240 to the annular plug 252. In at least one aspect, the condenser end cap 240 seals the condenser end of the heat pipe 200. Further, in at least one aspect, the evaporator end of the elongate tube 210 is sealed with an evaporator end cap that is similar to the condenser end cap 240.

Further to the above, the elongate stem 256 of the thermal expansion modification device defines a longitudinal axis that is coincident with the longitudinal axis LA of the elongate tube 210 when the thermal expansion modification device 250 is attached to the elongate tube 210, as shown in FIG. 3. Referring still to FIG. 3, the elongate stem 256 defines an inner passageway 257, an exterior surface 258, and a protrusion 259 extending radially outward from the exterior surface 258. In at least one aspect, at least a portion of the elongate stem 256 is a hollow cylinder and the protrusion 259 is an annular protrusion positioned on the evaporator end of the elongate stem 256. In at least one aspect, the protrusion 259 is an arcuate protrusion.

In use, when the thermal expansion modification device 250 is installed to elongate tube 210, the elongate stem 256 extends through the opening 234 in the wick plug 230 such that the protrusion 259 of the elongate stem 256 is positioned on the evaporator side of the wick plug 230, as shown in FIG. 3. In at least one aspect, the elongate stem 256, by itself, is first installed through the opening 234 in the wick plug 230 from the evaporator side of the wick plug 230. The annular plug 252 is then attached to the condenser side of the elongate stem 256 to capture the wick plug 230 between the protrusion 259 and the wick plug 252.

Further to the above, the wick plug 230 and the annular wick 220 are longitudinally movable relative to the elongate stem 256 and the elongate tube 210 within a range of movement permitted by the elongate stem 256. Specifically, the wick plug 230 is retainably positioned between the protrusion 259 of the elongate stem 256 and the annular plug 252 to prevent axial movement of the wick plug 230 toward the evaporator end beyond the protrusion 259. As discussed above, the wick plug 230 is attached to the annular wick 220 and, thus, the protrusion 259 of the elongate stem 256 prevents the annular wick 220 from moving further toward the evaporator end of the heat pipe 200 when the wick plug 230 abuts the protrusion 259.

Further to the above, as can be seen in FIG. 3, the inner passageway 257 of the elongate stem 256 and the inner passageway 254 of the annular plug 252 define an internal passageway extending through the entire axial length of the thermal expansion modification device 250. The internal passageway of the thermal expansion modification device 250 permits the heat pipe 200 to be filled with a working fluid, as discussed above.

Further to the above, in at least one aspect, the elongate stem 256 defines a plurality of axial slots intermediate a plurality of fingers that are flexible relative to the longitudinal axis LA of the elongate tube 210. Such an arrangement may help facilitate installing the elongate stem 256 through the wick plug 230 from the condenser end of the wick plug 230, for example. Further, in at least one aspect, the wick plug 230 comprises a keyway and the elongate stem 256 defines a key (e.g., a protrusion) extending radially outward into the keyway to prevent rotation of the wick plug 230 and wick 220 relative to the elongate stem 256 about the longitudinal axis LA of the elongate tube 210.

Further to the above, in at least one aspect, an inner diameter of the opening 234 in the wick plug 230 is sized to be larger than an outer diameter of the exterior surface 258 of the elongate stem 256. Because the outer diameter of the exterior surface 258 of the elongate stem 256 is sized to be smaller than the inner diameter of the opening 234 in the wick plug 230, the elongate stem 256 does not limit the rotation or centering of the annular wick 220 during operation. In at least one aspect, this may allow for flexible wick positioning in certain operational scenarios.

Further to the above, in various aspects, the wick plug 230 and wick 220 comprise a first material having a first co-efficient of thermal expansion. Further, the thermal expansion modification device 250, the elongate tube 210, and the condenser end cap 240 comprise a second material having a second co-efficient of thermal expansion. In at least one aspect, the second co-efficient of thermal expansion is different than the first co-efficient of thermal expansion. In at least one aspect, the second co-efficient of thermal expansion is less than the first co-efficient of thermal expansion. When the co-efficient of thermal expansion of the second material is less than that of the first material, the exterior surface 258 of the elongate stem 256 and the opening 234 of the wick plug 230 are prevented from interfering at elevated temperatures. In various aspects, the materials of the elongate tube 210, the condenser end cap 240, the evaporator end cap, the thermal expansion modification device 250, the wick plug 230, and the wick 220 are chosen such that they are compatible with alkali metals at elevated temperatures and such that they maintain an appropriate difference in thermal expansion so as to not interfere with surrounding components or normal heat pipe operation. In at least one aspect, the condenser end cap 240, the evaporator end cap, and the thermal expansion modification device 250 comprise FeCrAl. In at least one aspect, the annular wick 220 and the wick plug 230 comprises stainless steel or similar material. In at least one aspect, the elongate tube comprises FeCrAl or stainless steel.

Figure 4:
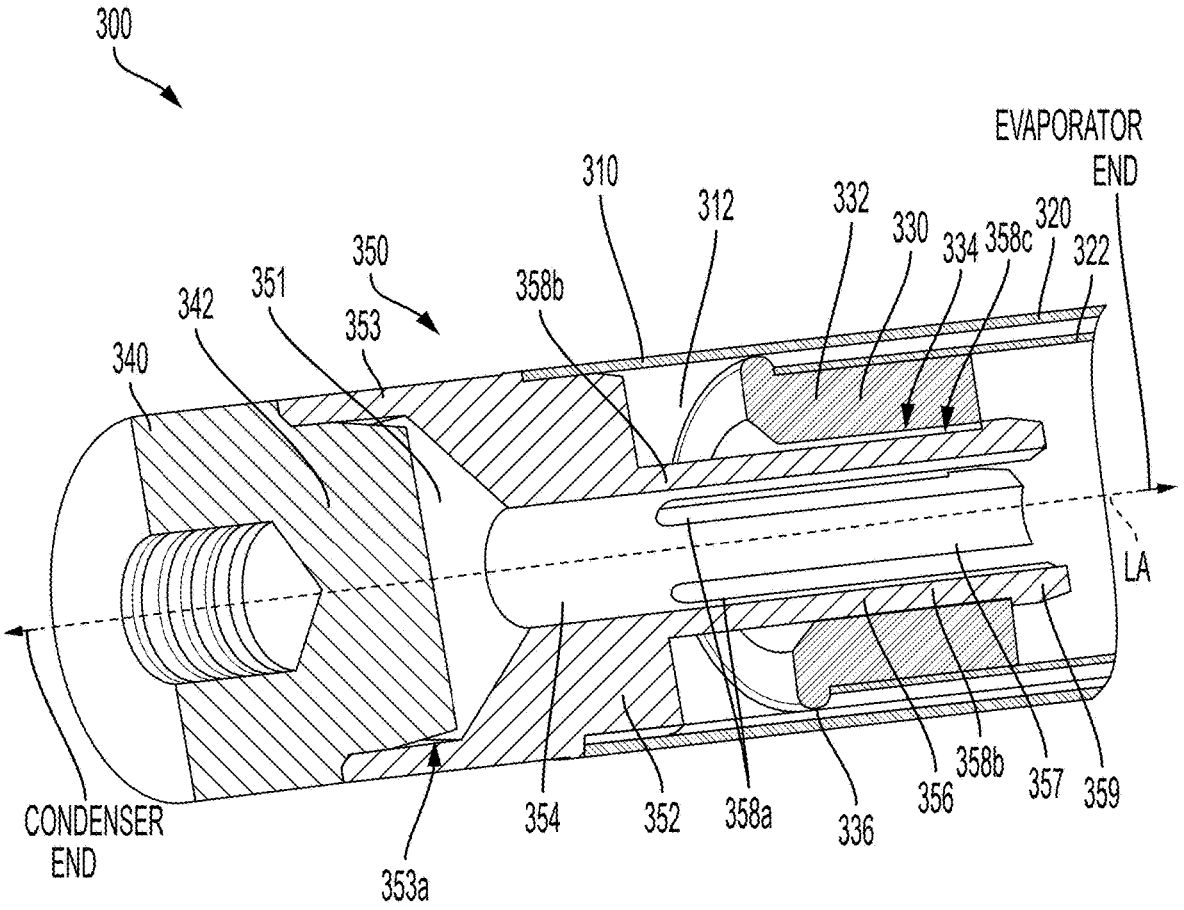
FIG. 4 is a cross-section view of a condenser end of another heat pipe including another thermal expansion modification device, in accordance with at least one aspect of the present disclosure.

FIG. 4 illustrates a heat pipe 300 including an elongate tube 310, an annular wick 320 positioned in an opening 312 defined in the elongate tube 310, and a wick plug 330 positioned in the elongate tube 310 and attached to the condenser end of the annular wick 320. The elongate tube 210 defines a longitudinal axis LA, and the wick plug 330 and the annular wick 320 can float axially within the elongate tube 310 along the longitudinal axis LA, under certain operating conditions. Further, the annular wick 320 defines an inner opening 322 which receives at least a portion of the wick plug 330 therein. The wick plug 330 comprises an annular body 332 defining an opening 334 and an annular protrusion 336 at the condenser end of the annular body 332. In at least one aspect, the wick plug 330 is press fit into the inner opening 322 of the annular wick 320. In at least one aspect, the wick plug 330 is attached to the annular wick 320 by welding or other suitable attachment methods. In at least one aspect, the wick plug 330 and the annular wick 320 include interlocking features to couple the wick plug 330 to the annular wick 320. In at least one aspect, the elongate tube 310, the annular wick 320, and the wick plug 330 are concentric about the longitudinal axis LA of the elongate tube 310.

Further to the above, the heat pipe 300 further comprises a condenser end cap 340 and a thermal expansion modification device 350 (e.g., a tube plug). The thermal expansion modification device 350 comprises an annular plug 352 and an elongate stem 356 extending from the annular plug 352. In at least one aspect, the annular plug 352 and the elongate stem 356 are a one-piece, unitary structure. In at least one aspect, the annular plug 352 and the elongate stem 356 are fabricated separately and attached together. In any event, the annular plug 352 comprises a flange portion 353 intermediate the elongate tube 310 and the condenser end cap 340. The flange portion 353 defines an opening 353*a* therein. At least a portion of the annular plug 352 is received within the opening 312 of the elongate tube 310 at the condenser end of the elongate tube 310. In at least one aspect, the annular plug 352 is press fit into the opening 312 of the elongate tube 310 and then welded to the elongate tube 310 to secure the annular plug 352 to the elongate tube 310.

Further to the above, the annular plug 352 defines a funnel shaped opening 351 and an inner passageway 354, and the elongate stem 356 defines an inner passageway 357. As can be seen in FIG. 4, the opening 353*a*, the funnel shaped opening 351, the inner passageway 354, and the inner passageway 357 define an internal passageway extending through the entire axial length of the thermal expansion modification device 350. The internal passageway of the thermal expansion modification device 350 permits the heat pipe 300 to be filled with a working fluid, as discussed above. Further, the condenser end cap 340 defines a cap plug 342 extending into the opening 353*a* of the annular plug 352. In at least one aspect, the cap plug 342 of the condenser end cap 340 is press fit into the opening 353*a* and then the condenser end cap 340 is welded to the annular plug 352 to secure the condenser end cap 340 to the annular plug 352. Further, the evaporator end of the elongate tube 310 is sealed with an evaporator end cap 360 (see FIG. 8).

Figure 7:
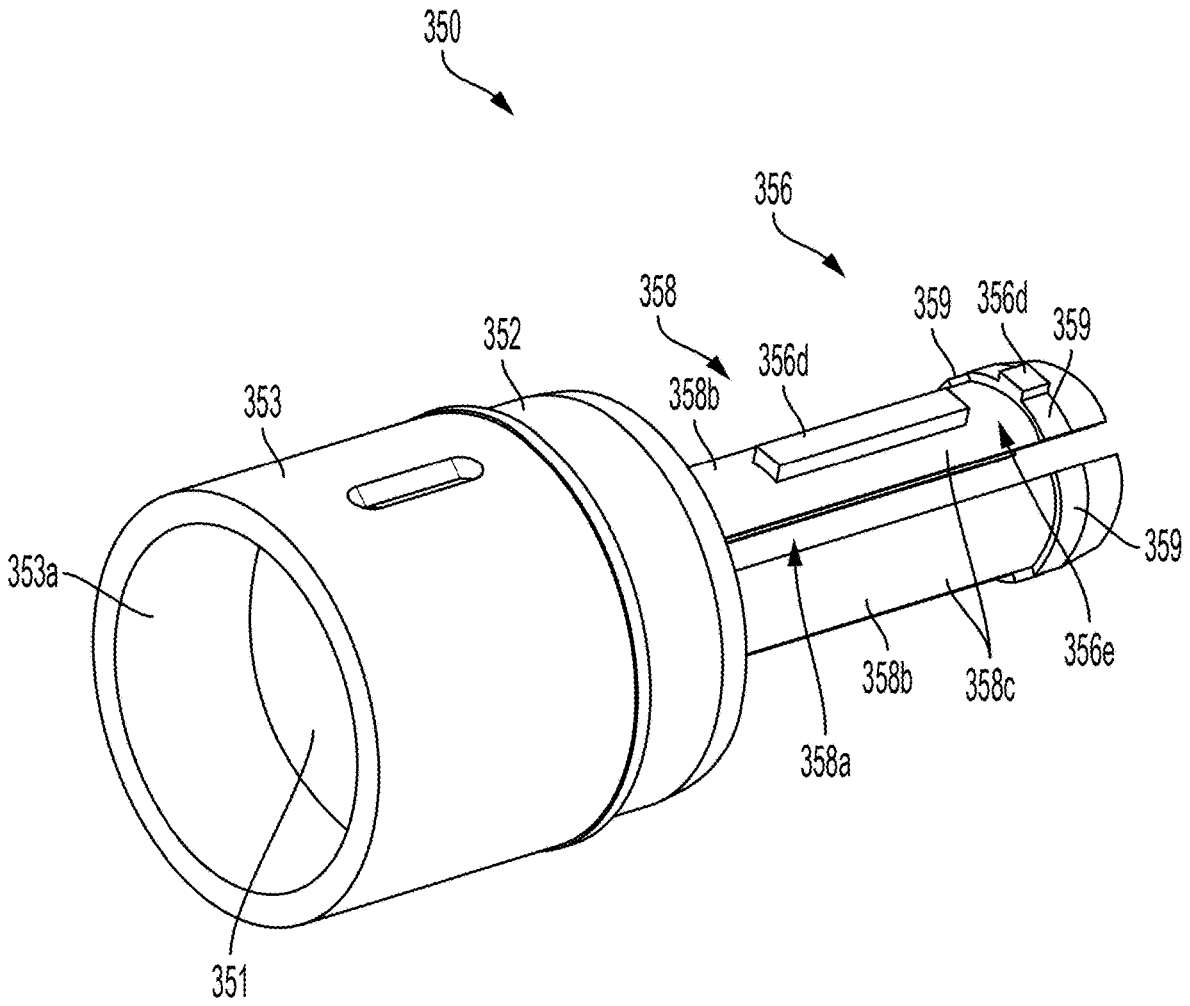
FIG. 7 is a perspective view of the thermal expansion modification device, in accordance with at least one aspect of the present disclosure.

Further to the above, the elongate stem 356 of the thermal expansion modification device 350 defines a longitudinal axis that is coincident with the longitudinal axis LA of the elongate tube 310 when the thermal expansion modification device 350 is attached to the elongate tube 310. Referring to FIGS. 4 and 7, the elongate stem 356 (e.g., shaft) comprises a body 358 defining a plurality of axial slots 358*a* intermediate a plurality of fingers 358*b*. In at least one aspect, the plurality of fingers 358*b* are flexible relative to the longitudinal axis LA of the elongate tube 310. In at least one aspect, the body 358 defines four axial slots 358*a* and four axial fingers 358*b*. In at least one aspect, the body 358 defines more than four axial slots 358*a* and more than four axial fingers 358*b*. In at least one aspect, the body 358 defines between one and four axial slots 358*a* and between one and four axial fingers 358*b*. In any event, the body 358 further defines a plurality of protrusions 359 extending from each of the fingers 358*b* on the evaporator end of the body 358. The protrusions 359 extend radially outward from an exterior surface 358*c* of each of the fingers 358*b* of the body 358 toward the elongate tube 310. In at least one aspect, the protrusions 359 are arcuate protrusions.

In use, after the thermal expansion modification device 350 is installed to elongate tube 310, the elongate stem 356 extends through the opening 334 in the wick plug 330 such that the protrusions 359 of the elongate stem 356 are positioned on the evaporator side of the wick plug 330, as shown in FIG. 4. In at least one aspect, the flexible fingers 358*b* of the elongate stem 356 can be flexed inward toward the longitudinal axis LA to facilitate installment of the elongate stem 356 through the opening 334 of the wick plug 330. In any event, after installation of the thermal expansion modification device 350, the wick plug 330 and the annular wick 320 are longitudinally movable relative to the elongate stem 356 and the elongate tube 310 within a range of movement permitted by the elongate stem 356, under certain operating conditions. Specifically, the wick plug 330 is retainably positioned between the protrusions 359 of the elongate stem 356 and the annular plug 352 to prevent axial movement of the wick plug 330 toward the evaporator end beyond the protrusions 359. As discussed above, the wick plug 330 is attached to the annular wick 320 and, thus, the protrusions 359 of the elongate stem 356 prevent the annular wick 320 from moving further toward the evaporator end of the heat pipe 300 when the wick plug 330 abuts the protrusions 359.

Further to the above, in at least one aspect, an inner diameter of the opening 334 of the wick plug 330 is sized to be larger than an outer diameter of the exterior surface 358*c* of the fingers 358*b* of the elongate stem 356. Because the outer diameter of the exterior surfaces 358*c* of the elongate stem 356 are sized to be smaller than the inner diameter of the opening 334 in the wick plug 330, the elongate stem 356 does not limit the rotation or centering of the annular wick 320 during operation. In at least one aspect, this may allow for flexible wick positioning in certain operational scenarios.

Figure 5:
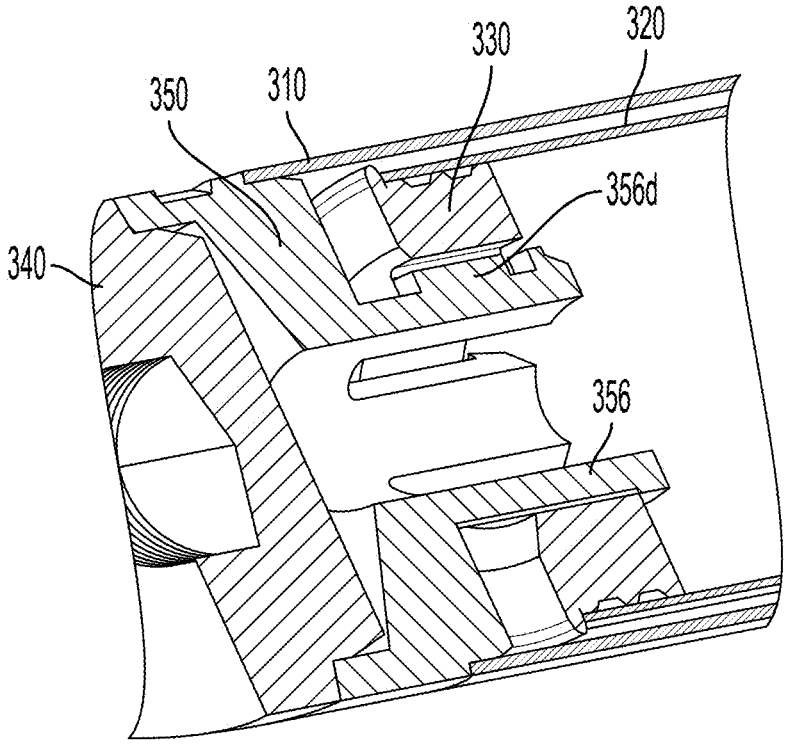
FIG. 5 is a cross-section perspective view of the heat pipe of FIG. 4, illustrating an interface between the thermal expansion modification device and a wick plug, in accordance with at least one aspect of the present disclosure.
Figure 6:
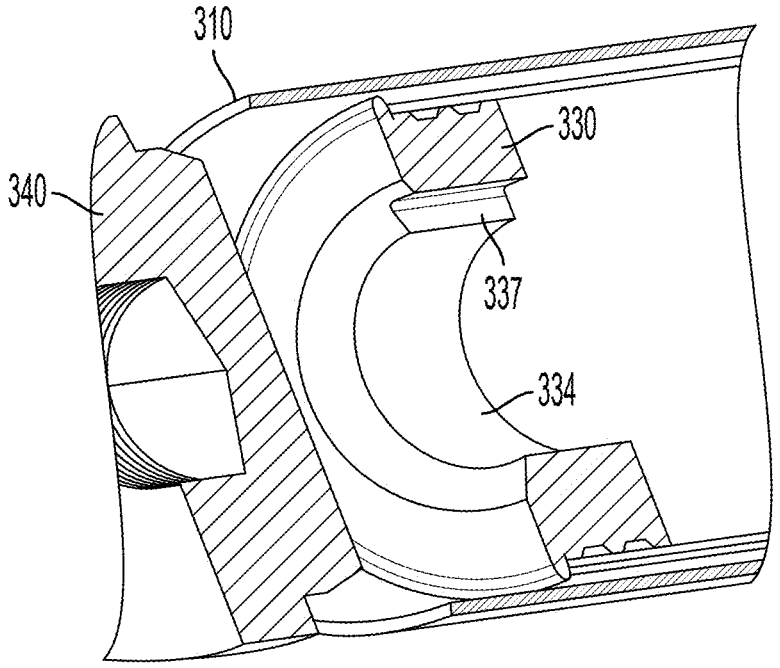
FIG. 6 is a cross-section perspective view of the heat pipe of FIG. 4, depicting the thermal expansion modification device removed, and further depicting a keyway defined in the wick plug, in accordance with at least one aspect of the present disclosure.

Further to the above, the wick plug 330 further comprises a keyway 337 (e.g., a recess) defined therein as shown in FIG. 6. The keyway 337 extends radially from the opening 334 and extends longitudinally along the axial length of the wick plug 330. Further, the elongate stem 356 defines a key 356*d* (e.g., a radial protrusion) extending radially outward toward the wick plug 330 as shown in FIG. 5 The key 356*d* is configured to extending into the keyway 337 to prevent rotation of the wick plug 330 and wick 320 relative to the elongate stem 356 about the longitudinal axis LA of the elongate tube 310. In at least one aspect, the key 356*d* defines a gap 356*e* (see FIG. 7). In at least one aspect, there is no gap defined in the key 356*d*.

Further to the above, in various aspects, the wick plug 330 and wick 320 comprise a first material having a first co-efficient of thermal expansion and the thermal expansion modification device 350, the elongate tube 310, and the condenser end cap 340 comprise a second material having a second co-efficient of thermal expansion. In at least one aspect, the second co-efficient of thermal expansion is different than the first co-efficient of thermal expansion. In at least one aspect, the second co-efficient of thermal expansion is less than the first co-efficient of thermal expansion. When the co-efficient of thermal expansion of the second material is less than that of the first material, the exterior surface 358*c* of the elongate stem 356 and the opening 334 in the wick plug 330 are prevented from interfering at elevated temperatures. In various aspects, the materials of the elongate tube 310, the condenser end cap 340, the evaporator end cap 360, the thermal expansion modification device 350, the wick plug 330, and the wick 320 are chosen such that they are compatible with alkali metals at elevated temperatures and maintain an appropriate difference in thermal expansion so as to not interfere with surrounding components or normal heat pipe operation. In at least one aspect, the condenser end cap 340, the evaporator end cap 360, the thermal expansion modification device 350 comprise FeCrAl. In at least one aspect, the annular wick 320 and the wick plug 330 comprises stainless steel. In at least one aspect, the elongate tube 310 comprises FeCrAl or stainless steel.

Figure 8:
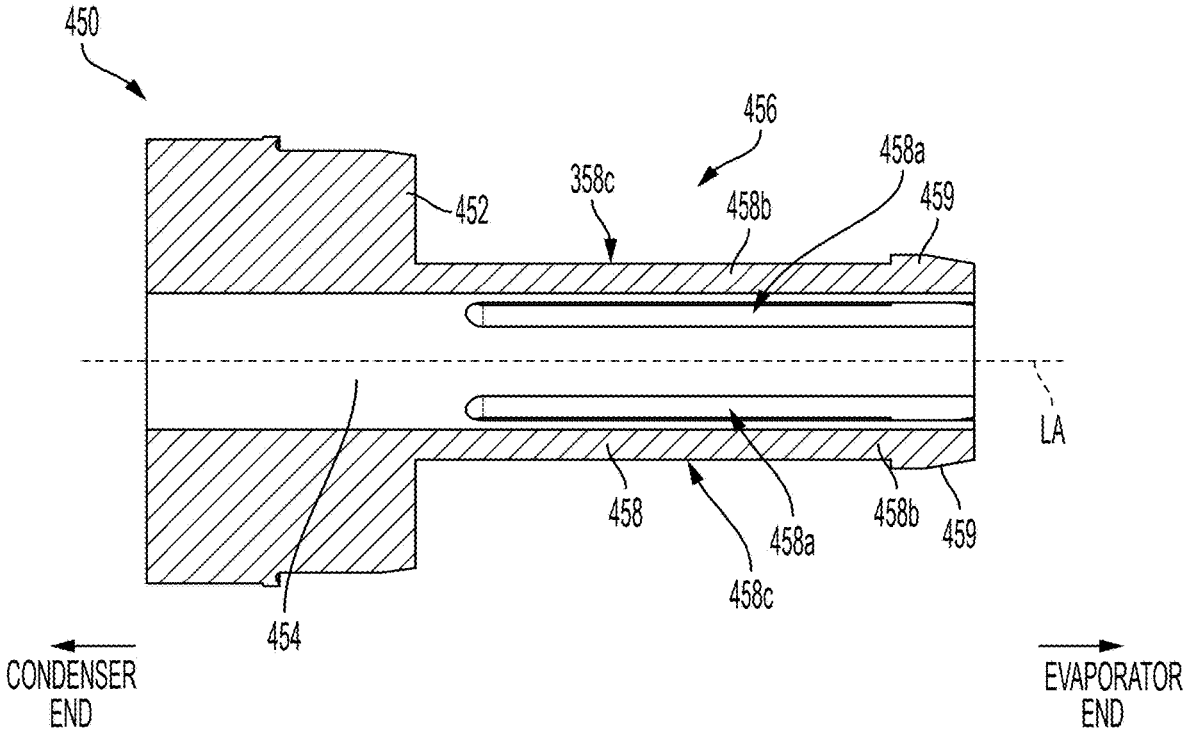
FIG. 8 is a cross-section view of another thermal expansion modification device, in accordance with at least one aspect of the present disclosure.

FIG. 8 illustrates another thermal expansion modification device 450 (e.g., a tube plug). The thermal expansion modification device 450 is similar to the thermal expansion modification devices 250, 350 except for the difference discussed herein. The thermal expansion modification device 450 may be used in a similar manner to the devices 250, 350 with the heat pipes 200, 300, for example. In any event, the thermal expansion modification device 450 comprises an annular plug 452 and an elongate stem 456 extending from the annular plug 452. The thermal expansion modification device 450 defines an inner passageway 454 extending through the entire axial length of thermal expansion modification device 450. In at least one aspect, the inner passageway 454 is circular and does not taper outward toward the condenser end of thermal expansion modification device 450 as compared to the thermal expansion modification device 350, for example. In other words, the thermal expansion modification device 450 does not comprise a funnel portion on the condenser end. In any event, the inner passageway 454 permits a heat pipe 300 to be filled with a working fluid when the thermal expansion modification device is attached to the heat pipe.

Further to the above, the elongate stem 456 (e.g., shaft) comprises a body 458 defining a plurality of axial slots 458*a* intermediate a plurality of fingers 458*b*. In at least one aspect, the plurality of fingers 458*b* are flexible relative to a longitudinal axis LA of the thermal expansion modification device 450. In at least one aspect, the body 458 defines four axial slots 458*a* and four axial fingers 458*b*. In at least one aspect, the body 458 defines more than four axial slots 458*a* and more than four axial fingers 458*b*. In at least one aspect, the body 458 defines between one and four axial slots 458*a* and between one and four axial fingers 458*b*. In any event, the body 458 further defines a plurality of protrusions 459 extending from each of the fingers 458*b* toward the evaporator end of the body 458. The protrusions 459 extend radially outward from an exterior surface 458*c* of each of the fingers 458*b* of the body 458 away from the longitudinal axis LA. In at least one aspect, the protrusions 459 are arcuate protrusions.

Further to the above, in various aspects the length of the elongate stem 256, 356, 456 is designed to be long enough axially so that the condenser end wick plug 230, 330 does not become pinned between the condenser end annular plug 252, 352 and the protrusion 259, 359 when the condenser end wick plug 230, 330 thermally expands. In various aspects the length of the elongate stem 256, 356, 456 is designed to be long enough axially for the condenser end wick plug 230, 330 to not pin itself to the elongate tube 210, 310 during thermal expansion in a position where the condenser end wick plug 230, 330 may thermally expand into the condenser end annular plug 252, 352 during startup which may cause the wick 220, 320 to buckle, as discussed in greater detail below.

Figure 9:
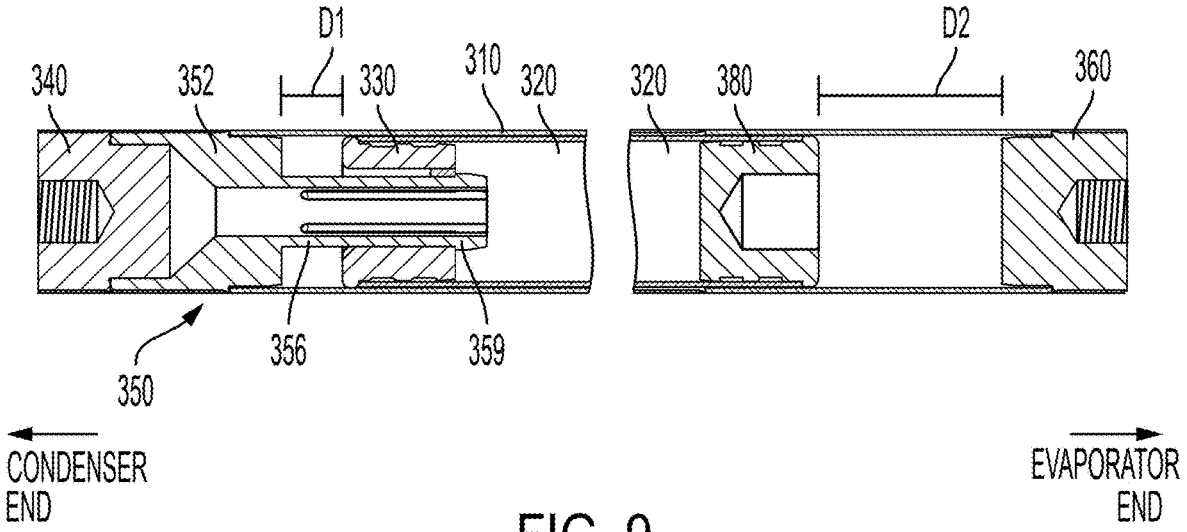
FIG. 9 is a cross-section view of the evaporator end and a condenser end of the heat pipe of FIG. 4 at room temperature, in accordance with at least one aspect of the present disclosure.
Figure 10:
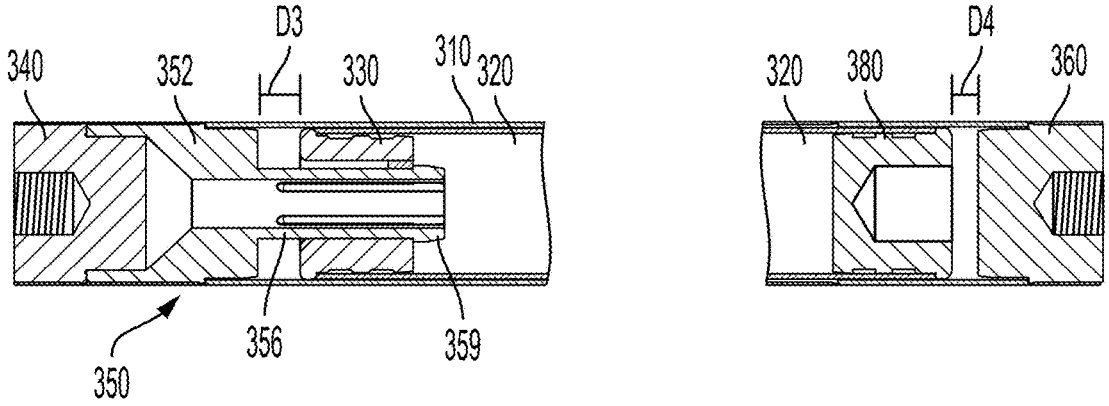
FIG. 10 a cross-section view of the evaporator end and the condenser end of the heat pipe of FIG. 4 at an elevated temperature, in accordance with at least one aspect of the present disclosure.

FIG. 9 illustrates the heat pipe 300 at a room temperature configuration and FIG. 10 illustrates the heat pipe 300 at an elevated temperature configuration. It should be understood that the following examples of differential thermal expansion in relation to the heat pipe 300 are the same or similar for the heat pipe 200. In any event, referring to FIG. 9, the heat pipe 300 further comprises an evaporator end wick plug 380 attached to the evaporator end of the annular wick 320. Further, as discussed above, the evaporator end cap 360 is attached to the evaporator end of the elongate tube 310 to seal the evaporator end of the elongate tube 310. Referring still to FIG. 9, when the heat pipe 300 is at room temperature the condenser end wick plug 330 is spaced from the annular plug 352 a first distance D1 and the evaporator end wick plug 380 is spaced from the evaporator end cap 360 a second distance D2. During heating of the heat pipe 300 from room temperature, the annular wick 320 may float axially relative to the elongate tube 310. After initially heating the heat pipe 300 from room temperature, the evaporator end wick plug 330 may be spaced the first distance D1 from the annular plug 352 and the condenser end wick plug 380 may be spaced from the condenser end cap 360 the second distance D2. As such, in at least one aspect, the first distance D1 and the second distance D2 are the same at room temperature as they are upon initial heating of the heat pipe 300. In other instances, the distances D1 and D2 may be different at room temperature and upon initial heating due to the annular wick 320 floating axially into a different axial position upon initial heating of the heat pipe 300.

Referring now to FIG. 10, when the heat pipe 300 is raised to an elevated temperature after initial heating, the condenser end wick plug 330 may be spaced from the annular plug 352 a third distance D3 that is less than the first distance D1, due to axial thermal expansion, and the evaporator end wick plug 380 may be spaced from the evaporator end cap 360 a fourth distance D4 that is less than the second distance D2, due to axial thermal expansion. In various aspects, the axial length of the elongate stem 356 and the axial length of the annular wick 320 can be sized in order to prevent the annular wick 320 from becoming compressed between the annular plug 352 and the evaporator end cap 360 which may result in buckling of the annular wick 320 at elevated temperatures, as discussed in greater detail below.

In at least one aspect, for a given annular wick 320 length at room temperature, the axial length of the floating annular wick 320 and the axial length of the elongate stem 356 can be sized to ensure that a gap will be available at both the condenser end and the evaporator end to allow for thermal expansion of the heat pipe 300. As discussed above, the elongate stem 356 and protrusions 359 of the thermal expansion modification device 350 axially restrict where the wick plug 330 can float within the heat pipe 300. Specifically, the wick plug 330 cannot move any further toward the evaporator end than right up against the annular protrusions 359. As such, the longitudinal length of the annular wick 320 and the elongate stem 356 can be sized for different temperature ranges such that when the heat pipe 300 is heated to an elevated temperature, there will be at least some amount of gap between the annular wick 320 and the annular plug 352 and at least some amount of gap between the annular wick 320 and the evaporator end cap 360 at the selected elevated temperature. Preventing buckling and/or excessive compression of the annular wick 320 is crucial to prevent the capillary capability of the annular wick 320 from becoming degraded or wholly compromised.

Various aspects of the present disclosure include, but are not limited to, the aspects listed in the following numbered clauses.

Clause 1—A heat pipe, including: an elongate tube defining a longitudinal axis; an annular wick positioned in the elongate tube; a wick plug positioned in the elongate tube and attached to an end of the annular wick, where the wick plug includes an annular body defining an opening; a thermal expansion modification device, including: an annular plug attached to an end of the elongate tube; and an elongate stem extending from the annular plug and through the opening in the wick plug, where the elongate stem defines a protrusion extending radially relative to the longitudinal axis toward the elongate tube, and where the wick plug is positioned intermediate the protrusion and the annular plug; and an end cap attached to the annular plug.

Clause 2—The heat pipe of Clause 1, where the protrusion is an arcuate protrusion.

Clause 3—The heat pipe of Clause 1 or 2, where the wick plug and the annular wick are longitudinally movable relative to the elongate stem and the elongate tube.

Clause 4—The heat pipe of Clause 1, where the wick plug is retainably positioned between the protrusion and the annular plug.

Clause 5—The heat pipe any one of Clauses 1-4, where the wick plug includes a first material having a first co-efficient of thermal expansion and the thermal expansion modification device includes a second material having a second co-efficient of thermal expansion that is different than the first co-efficient of thermal expansion.

Clause 6—The heat pipe of Clause 5, where the second co-efficient of thermal expansion is less than the first co-efficient of thermal expansion.

Clause 7—The heat pipe of Clause 1, where the annular plug and the elongate stem define an internal passageway therethrough.

Clause 8—The heat pipe of Clause 1, where the elongate stem includes a body defining a plurality of axial slots intermediate a plurality of fingers.

Clause 10—The heat pipe of Clause 1, where the wick plug includes a keyway and the elongate stem defines a protrusion extending into the keyway to prevent rotation of the wick plug relative to the elongate stem about the longitudinal axis of the elongate tube.

Clause 11—A heat pipe, including: an elongate tube defining a longitudinal axis; an annular wick positioned in the elongate tube; a wick plug positioned in the elongate tube and attached to an end of the annular wick, where the wick plug includes an annular body defining an opening; and a tube plug, including: an annular plug attached to an end of the elongate tube; and a shaft extending from the annular plug and through the opening in the annular wick, where the shaft defines a protrusion extending radially toward the elongate tube, and where the wick plug is positioned intermediate the protrusion and the annular plug.

Clause 12—The heat pipe of Clause 11, where the protrusion is an arcuate protrusion.

Clause 13—The heat pipe of Clause 11 or 12, where the wick plug and the annular wick are longitudinally movable relative to the tube plug and the elongate tube.

Clause 14—The heat pipe of Clause 11, where the wick plug is retainably positioned between the protrusion and the annular plug.

Clause 15—The heat pipe any one of Clauses 11-14, where the wick plug includes a first material having a first co-efficient of thermal expansion and the tube plug includes a second material having a second co-efficient of thermal expansion that is different than the first co-efficient of thermal expansion.

Clause 16—The heat pipe of Clause 15, where the second co-efficient of thermal expansion is less than the first co-efficient of thermal expansion.

Clause 17—The heat pipe of Clause 11, where the annular plug and the shaft define an internal passageway therethrough.

Clause 18—The heat pipe of Clause 11, where the shaft defines a plurality of axial slots intermediate a plurality of fingers.

Clause 19—The heat pipe of Clause 18, where the plurality of fingers are flexible relative to the longitudinal axis of the elongate tube.

Clause 20—The heat pipe of Clause 11, where the wick plug includes a keyway and the shaft defines a radial protrusion extending into the keyway to prevent rotation of the wick plug relative to the shaft about the longitudinal axis of the elongate tube.

Clause 21—A thermal expansion modification device, including: an annular plug attached to an end of an elongate tube; an elongate stem extending from the annular plug, the elongate stem defining a longitudinal axis, an exterior surface, and a protrusion extending radially outward from the exterior surface; and an internal passage extending through the annular plug and the elongate stem.

Clause 22—The thermal expansion modification device of Clause 21, where the protrusion is arcuate.

Clause 23—The thermal expansion modification device of Clause 21, where the elongate stem includes a body defining a plurality of axial slots intermediate a plurality of fingers.

Clause 24—The thermal expansion modification device of Clause 23, where the plurality of fingers are flexible relative to the longitudinal axis of the elongate stem.

All patents, patent applications, publications, or other disclosure material mentioned herein, are hereby incorporated by reference in their entirety as if each individual reference was expressly incorporated by reference respectively. All references, and any material, or portion thereof, that are said to be incorporated by reference herein are incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference and the disclosure expressly set forth in the present application controls.

The present disclosure has been described with reference to various exemplary and illustrative aspects. The aspects described herein are understood as providing illustrative features of varying detail of various aspects of the disclosed disclosure; and therefore, unless otherwise specified, it is to be understood that, to the extent possible, one or more features, elements, components, constituents, ingredients, structures, modules, and/or aspects of the disclosed aspects may be combined, separated, interchanged, and/or rearranged with or relative to one or more other features, elements, components, constituents, ingredients, structures, modules, and/or aspects of the disclosed aspects without departing from the scope of the disclosed disclosure. Accordingly, it will be recognized by persons having ordinary skill in the art that various substitutions, modifications or combinations of any of the exemplary aspects may be made without departing from the scope of the disclosure. In addition, persons skilled in the art will recognize, or be able to ascertain using no more than routine experimentation, many equivalents to the various aspects of the disclosure described herein upon review of this specification. Thus, the disclosure is not limited by the description of the various aspects, but rather by the claims.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although claim recitations are presented in a sequence(s), it should be understood that the various operations may be performed in other orders than those which are described, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

As used herein, the singular form of "a", "an", and "the" include the plural references unless the context clearly dictates otherwise.

Directional phrases used herein, such as, for example and without limitation, top, bottom, left, right, lower, upper, front, back, and variations thereof, shall relate to the orientation of the elements shown in the accompanying drawing and are not limiting upon the claims unless otherwise expressly stated.

The terms "about" or "approximately" as used in the present disclosure, unless otherwise specified, means an acceptable error for a particular value as determined by one of ordinary skill in the art, which depends in part on how the value is measured or determined. In certain aspects, the term "about" or "approximately" means within 1, 2, 3, or 4 standard deviations. In certain aspects, the term "about" or "approximately" means within 50%, 200%, 105%, 100%, 9%, 8%, 7%, 6%, 5%, 4%, 3%, 2%, 1%, 0.5%, or 0.05% of a given value or range.

In this specification, unless otherwise indicated, all numerical parameters are to be understood as being prefaced and modified in all instances by the term "about," in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described herein should at least be construed in light of the number of reported significant digits and by applying ordinary rounding techniques.

Any numerical range recited herein includes all sub-ranges subsumed within the recited range. For example, a range of "1 to 100" includes all sub-ranges between (and including) the recited minimum value of 1 and the recited maximum value of 100, that is, having a minimum value equal to or greater than 1 and a maximum value equal to or less than 100. Also, all ranges recited herein are inclusive of the end points of the recited ranges. For example, a range of "1 to 100" includes the end points 1 and 100. Any maximum numerical limitation recited in this specification is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited. All such ranges are inherently described in this specification.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features.

What is claimed is:

1. A heat pipe, comprising:
an elongate tube defining a longitudinal axis;
an annular wick positioned in the elongate tube;
a wick plug positioned in the elongate tube and attached to an end of the annular wick, wherein the wick plug comprises an annular body defining an opening;
a thermal expansion modification device, comprising:
an annular plug attached to an end of the elongate tube; and
an elongate stem extending from the annular plug and through the opening in the wick plug, wherein the elongate stem defines a protrusion extending radially relative to the longitudinal axis toward the elongate tube, and wherein the wick plug is positioned intermediate the protrusion and the annular plug; and
an end cap attached to the annular plug.

2. The heat pipe of claim 1, wherein the protrusion is an arcuate protrusion.

3. The heat pipe of claim 1, wherein the wick plug and the annular wick are longitudinally movable relative to the elongate stem and the elongate tube.

4. The heat pipe of claim 1, wherein the wick plug is retainably positioned between the protrusion and the annular plug.

5. The heat pipe of claim 1, wherein the wick plug comprises a first material having a first co-efficient of thermal expansion and the thermal expansion modification device comprises a second material having a second co-efficient of thermal expansion that is different than the first co-efficient of thermal expansion.

6. The heat pipe of claim 5, wherein the second co-efficient of thermal expansion is less than the first co-efficient of thermal expansion.

7. The heat pipe of claim 1, wherein the annular plug and the elongate stem define an internal passageway therethrough.

8. The heat pipe of claim 1, wherein the elongate stem comprises a body defining a plurality of axial slots intermediate a plurality of fingers.

9. The heat pipe of claim 8, wherein the plurality of fingers are flexible relative to the longitudinal axis of the elongate tube.

10. The heat pipe of claim 1, wherein the wick plug comprises a keyway and the elongate stem defines a protrusion extending into the keyway to prevent rotation of the wick plug relative to the elongate stem about the longitudinal axis of the elongate tube.

11. A heat pipe, comprising:
an elongate tube defining a longitudinal axis;
an annular wick positioned in the elongate tube;
a wick plug positioned in the elongate tube and attached to an end of the annular wick, wherein the wick plug comprises an annular body defining an opening; and
a tube plug, comprising:
an annular plug attached to an end of the elongate tube; and
a shaft extending from the annular plug and through the opening in the annular wick, wherein the shaft defines a protrusion extending radially toward the elongate tube, and wherein the wick plug is positioned intermediate the protrusion and the annular plug.

12. The heat pipe of claim 11, wherein the protrusion is an arcuate protrusion.

13. The heat pipe of claim 11, wherein the wick plug and the annular wick are longitudinally movable relative to the tube plug and the elongate tube.

14. The heat pipe of claim 11, wherein the wick plug is retainably positioned between the protrusion and the annular plug.

15. The heat pipe of claim 11, wherein the wick plug comprises a first material having a first co-efficient of thermal expansion and the tube plug comprises a second material having a second co-efficient of thermal expansion that is different than the first co-efficient of thermal expansion.

16. The heat pipe of claim 15, wherein the second co-efficient of thermal expansion is less than the first co-efficient of thermal expansion.

17. The heat pipe of claim 11, wherein the annular plug and the shaft define an internal passageway therethrough.

18. The heat pipe of claim 11, wherein the shaft defines a plurality of axial slots intermediate a plurality of fingers.

19. The heat pipe of claim 18, wherein the plurality of fingers are flexible relative to the longitudinal axis of the elongate tube.

20. The heat pipe of claim 11, wherein the wick plug comprises a keyway and the shaft defines a radial protrusion extending into the keyway to prevent rotation of the wick plug relative to the shaft about the longitudinal axis of the elongate tube.

* * * * *